US008492060B2

(12) United States Patent
Choi et al.

(10) Patent No.: US 8,492,060 B2
(45) Date of Patent: Jul. 23, 2013

(54) METHOD OF FORMING TONER IMAGE AND ELECTROPHOTOGRAPHIC IMAGE FORMING APPARATUS CAPABLE OF REALIZING WIDE COLOR GAMUT

(75) Inventors: Dae Woong Choi, Daejeon (KR); Woo Young Yang, Daejeon (KR); Keon Il Kim, Daejeon (KR); Dae Il Hwang, Daejeon (KR); Il Hyuk Kim, Daejeon (KR); Jae Bum Park, Daejeon (KR); Il Sun Hwang, Daejeon (KR); Jae Kwang Hwang, Daejeon (KR); Dong Won Kim, Daejeon (KR); Duck Kyun Ahn, Daejeon (KR)

(73) Assignee: Samsung Fine Chemicals Co., Ltd., Ulsan (KR)

( * ) Notice: Subject to any disclaimer, the term of this patent is extended or adjusted under 35 U.S.C. 154(b) by 207 days.

(21) Appl. No.: 12/996,365

(22) PCT Filed: Jun. 4, 2009

(86) PCT No.: PCT/KR2009/002987

§ 371 (c)(1),
(2), (4) Date: Dec. 3, 2010

(87) PCT Pub. No.: WO2009/148276

PCT Pub. Date: Dec. 10, 2009

(65) Prior Publication Data

US 2011/0159424 A1 Jun. 30, 2011

(30) Foreign Application Priority Data

Jun. 4, 2008 (KR) ..... 10-2008-0052682

(51) Int. Cl.
*G03G 9/08* (2006.01)

(52) U.S. Cl.
USPC ... 430/107.1; 430/42.1; 430/45.5; 430/125.5; 399/252

(58) Field of Classification Search
USPC ..... 430/107.1, 42.1, 45.5, 125.5, 125.57; 399/252
See application file for complete search history.

(56) References Cited

U.S. PATENT DOCUMENTS

| | | | | |
|---|---|---|---|---|
| 6,203,957 | B1 | 3/2001 | Nomura | |
| 6,824,942 | B2 * | 11/2004 | Silence et al. | 430/108.4 |
| 2006/0115631 | A1 * | 6/2006 | Nair et al. | 428/195.1 |

FOREIGN PATENT DOCUMENTS

| | | |
|---|---|---|
| EP | 0 915 386 A2 | 5/1999 |
| EP | 0 915 386 A3 | 10/1999 |

(Continued)

OTHER PUBLICATIONS

International Search Report, PCT/KR2009/002987, dated Jan. 6, 2010.

(Continued)

*Primary Examiner* — Mark A Chapman
(74) *Attorney, Agent, or Firm* — Nixon Peabody LLP

(57) ABSTRACT

Provided are a method of forming a toner image and an electrophotographic image forming apparatus including a toner. The method of forming a toner image is performed using a first toner having a yellow color and color coordinate values of a lightness (L) ranging from 91 to 94, a redness (a) ranging from −11 to −9, and a yellowness (b) ranging from 77 to 82; a second toner having a magenta color and color coordinate values of a lightness (L) ranging from 56 to 61, a redness (a) ranging from 56 to 61, and a yellowness (b) ranging from −7 to −5; and a third toner having a cyan color and color coordinate values of a lightness (L) ranging from 58 to 62, a redness (a) ranging from −33 to −30, and a yellowness (b) ranging from −42 to −37.

3 Claims, 1 Drawing Sheet

FOREIGN PATENT DOCUMENTS

| | | | |
|---|---|---|---|
| EP | 1319993 | A1 | 6/2003 |
| JP | 2000-199982 | | 7/2000 |
| JP | 2001-312102 | | 11/2001 |
| JP | 2003-034765 | | 2/2003 |
| JP | 2003-186246 | | 7/2003 |
| JP | 2004-138727 | | 5/2004 |
| JP | 2005-084413 | | 3/2005 |
| JP | 2005316058 | A | 11/2005 |

OTHER PUBLICATIONS

Extended European Search Report and Opinion in European Application No. 09758529.3, dated Jan. 13, 2012.

* cited by examiner

METHOD OF FORMING TONER IMAGE AND ELECTROPHOTOGRAPHIC IMAGE FORMING APPARATUS CAPABLE OF REALIZING WIDE COLOR GAMUT

CROSS-REFERENCE TO RELATED PATENT APPLICATION

This application is a national phase of International Application No. PCT/KR2009/002987, entitled "METHOD OF FORMING TONER IMAGE AND ELECTROPHOTOGRAPHIC IMAGE FORMING APPARATUS CAPABLE OF REALIZING WIDE COLOR GAMUT", which was filed on Jun. 4, 2009, and which claims priority to Korean Patent Application No. 10-2008-0052682, filed on Jun. 4, 2008, in the Korean Intellectual Property Office, the disclosure of which is incorporated herein in its entirety by reference.

BACKGROUND OF THE INVENTION

1. Technical Field

The present invention relates to a method of forming a toner image and an electrophotographic image forming apparatus including a toner, and more particularly, to a method of forming a toner image and an electrophotographic image forming apparatus including a toner, capable of realizing a wide color gamut.

2. Background Art

In image forming apparatuses such as laser printers, photocopiers, and multifunction devices, toner particle size needs to be decreased and a color gamut needs to be increased to speed up operations of the image forming apparatuses, fix toner images at low temperature, and to form high-resolution images. In this regard, the color gamut may be determined by lightness (L), redness (a), and yellowness (b) displayed in color coordinates. That is, if 'a' is a negative value, a green color gamut is obtained, and if 'a' is a positive value, a red color gamut is obtained. If 'b' is a negative value, a blue color gamut is obtained, and if 'b' is a positive value, a yellow color gamut is obtained.

A method of developing toner is classified into a two-component developing method using toner and carriers, and a one-component developing method using toner only.

Meanwhile, as the price of personal computers (PCs) decreases with the development of information-communication and media technology, the number of PCs in use has become increased. Accordingly, the number of laser printers as well as inkjet printers for professional and personal use has also become increased. Thus, image forming apparatuses employing the one-component developing method, which are suitable for small-sized and low-priced laser printers, have become more important.

In general, toner is prepared by mixing a thermoplastic resin as a binder resin, with a colorant, a charge control agent, a release agent, or the like. In order to improve physical properties such as fluidity, charge controlling properties, or cleaning properties of toner, fine particles of inorganic metal such as hydrophobic silica and titanium oxide; fluorinated polymer particles; or poly(methyl methacrylate) (PMMA) particles may further be added to the toner as external additives.

Color of toner images may vary according to functions of materials added into toner that is an electrophotographic developer. A toner image may have a natural color by using toner having a wide color gamut.

U.S. Pat. No. 6,203,957 discloses spherical toner particles using a colorant. The toner using only a colorant has excellent lightfastness but a narrow color gamut.

Japanese Patent Publication No. 2003-34765 discloses a color inkjet ink set using dyes. The dyes used in the ink are water-soluble dyes, and the inks are classified into a magenta ink, a yellow ink, a cyan ink, an orange ink, a green ink, and a violet ink according to the color of the dyes. The ink set may form images having an excellent color gamut. However, the ink set has poor lightfastness due to the dyes.

European Patent No. 0915386 discloses a method of polymerizing toner by preparing polymer resin particles using seed polymerization or dispersion polymerization, and dispersing the polymer resin particles and dyes in a solvent. However, since dyes are used for the polymerization of toner, the toner has poor lightfastness despite a high image density and wide color gamut.

DETAILED DESCRIPTION OF THE INVENTION

Technical Problem

The present invention provides a method of forming a toner image capable of realizing a wide color gamut and having excellent lightfastness.

The present invention also provides an electrophotographic image forming apparatus capable of realizing a wide color gamut and having excellent lightfastness.

Technical Solution

According to an aspect of the present invention, there is provided a method of forming a toner image, the method performed using:

a first toner having a yellow color and color coordinate values of a lightness (L) ranging from 91 to 94, a redness (a) ranging from −11 to −9, and a yellowness (b) ranging from 77 to 82;

a second toner having a magenta color and color coordinate values of a lightness (L) ranging from 56 to 61, a redness (a) ranging from 56 to 61, and a yellowness (b) ranging from −7 to −5; and a third toner having a cyan color and color coordinate values of a lightness (L) ranging from 58 to 62, a redness (a) ranging from −33 to −30, and a yellowness (b) ranging from −42 to −37.

The first to third toners may respectively include 0.05 to 2.0% by weight of a fluorescent pigment based on the weight of each of the first to third toners.

The fluorescent pigment may be selected from the group consisting of 4,4'-bis(styryl)biphenyl, 2-(4-phenylstilbene-4-yl)-6-butylbenzoxazole, β-methylumbelliferon, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene.

According to an aspect of the present invention, there is provided a image forming apparatus including:

a first toner having a yellow color and color coordinate values of a lightness (L) ranging from 91 to 94, a redness (a) ranging from −11 to −9, and a yellowness (b) ranging from 77 to 82;

a second toner having a magenta color and color coordinate values of a lightness (L) ranging from 56 to 61, a redness (a) ranging from 56 to 61, and a yellowness (b) ranging from −7 to −5; and a third toner having a cyan color and color coordinate values of a lightness (L) ranging from 58 to 62, a redness (a) ranging from −33 to −30, and a yellowness (b) ranging from −42 to −37.

BRIEF DESCRIPTION OF THE DRAWINGS

The above and other features and advantages of the present invention will become more apparent by describing in detail exemplary embodiments thereof with reference to the attached drawings in which:

FIG. 1 illustrates color coordinates obtained by forming a toner image by using an electrophotographic image forming apparatus including a toner according to an embodiment of the present invention, and obtaining color difference data of the toner image using a colorimeter; and.

BEST MODE FOR CARRYING OUT THE INVENTION

Figure 1:
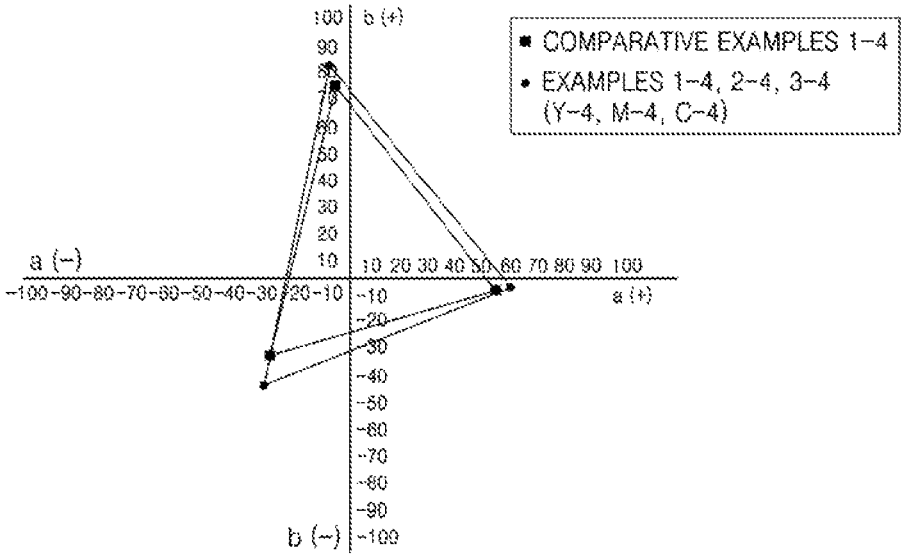

Hereinafter, the present invention will now be described more fully with reference to the accompanying drawings, in which exemplary embodiments of the invention are shown.

A method of forming a toner image according to an embodiment of the present invention is performed using a first toner having a yellow color and color coordinate values of a lightness (L) ranging from 91 to 94, a redness (a) ranging from −11 to −9, and a yellowness (b) ranging from 77 to 82; a second toner having a magenta color and color coordinate values of a lightness (L) ranging from 56 to 61, a redness (a) ranging from 56 to 61, and a yellowness (b) ranging from −7 to −5; and a third toner having a cyan color and color coordinate values of a lightness (L) ranging from 58 to 62, a redness (a) ranging from −33 to −30, and a yellowness (b) ranging from −42 to −37.

A color gamut of a toner image obtained using the first, second, and/or third toners may be identified by filling the toners in a cartridge of a CLP-510 color printer (Samsung), printing a standard chart (a QEA chart), and measuring L, a, and b of a first color (Yellow, Magenta, Cyan) of a toner image printed on a printing medium using a SpectroEye (Macbeth).

In order to realize the wide color gamut, each of the first to third toners may include 0.05 to 2.0%, preferably 0.1 to 1.0%, by weight of a fluorescent pigment based on the weight of the toners. If the fluorescent pigment is less than 0.05% by weight, a desired color gamut may not be obtained. On the other hand, if the fluorescent pigment is greater than 2.0% by weight, the toners may discolor and thus affect the image. A wide color gamut of the toner image may be obtained by forming images using toners having the fluorescent pigment. However, various toners that may realize the color gamut may be used without limitation.

The fluorescent pigment may be selected from the group consisting of 4,4'-bis(styryl)biphenyl, 2-(4-phenylstilbene-4-yl)-6-butylbenzoxazole, β-methylumbelliferon, 4-methyl-7-dimethylaminocoumarin, 4-methyl-7-aminocoumarin, N-methyl-4-methoxy-1,8-naphthalimide, 9,10-bis(phenethynyl)anthracene, 5,12-bis(phenethynyl)naphthacene, FB205™ (Uk Seong Chemical Co., Ltd.), FZ 27110™ (Sinloihi Co., Ltd.), and FZ SB BLUE™ (Sinloihi Co., Ltd.), but is not limited thereto. However, any fluorescent pigment with various types and shapes that emits fluorescence by ultraviolet (UV) rays contained in sunlight may be used.

The first to third toners may include a binder resin, a colorant, and at least one additive.

The binder resin may be contained in parent toner particles to hold other components of the toner, e.g., a colorant, a charge control agent, a release agent, and/or external additives and adhere or stick the toner to a printing medium. The binder resin may be formed of various resins known in the art, for example, styrene-based copolymers such as polystyrene, poly-p-chlorostyrene, poly-α-methylstyrene, styrene-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-acrylonitrile-indene copolymer, and styrene-maleic acid copolymer, styrene-maleic ester copolymer; polymethyl methacrylate, polyethyl methacrylate, polybutyl methacrylate, and copolymers thereof; polyvinyl chloride, polyvinyl acetate, polyethylene, polypropylene, polyester, polyurethane, polyamide, epoxy resin, polyvinyl butyral resin, rosin, modified rosin, terpene resin, phenol resin, aliphatic or alicyclic hydrocarbon resin, aromatic petroleum resin, chlorinated paraffin, paraffin wax, etc. These resins may be used alone or in combination. Polyester-based resins are suitable for a color toner due to their excellent fixing properties and transparency.

The amount of the binder resin may be in the range of 50 to 98% by weight based on the weight of each of the toners. If the amount of the binder resin is less than 50% by weight, the binder resin does not sufficiently bind the toner composition. On the other hand, if the amount of the binder resin is greater than 98% by weight, the amount of the other toner composition than the binder resin is too small to function as a toner. In this regard, the toner composition includes a colorant, additives, etc., which will be described later, in addition to the binder resin in a broad sense.

The colorant is used to give color to the toner. Currently, electrophotographic toners include black (K), yellow (Y), magenta (M), and cyan (C) colorants. The toners may be used in an electrophotographic image forming apparatus. An electrophotographic image forming apparatus including a toner only having black colorant is referred to as a black and white image forming apparatus, and an electrophotographic image forming apparatus including 4 toners respectively having each of the 4 colors is referred to as a color image forming apparatus.

The black colorant may be iron oxide, carbon black, titanium oxide, or the like.

For the yellow colorant, a condensation nitrogen compound, an isoindolinone compound, an anthraquine compound, an azo metal complex, or an allyl imide compound may be used. In detail, C.I. pigment yellow 12, 13, 14, 17, 62, 74, 83, 93, 94, 95, 109, 110, 111, 128, 129, 147, 168, etc. may be used.

For the magenta colorant, a condensation nitrogen compound, an anthraquine compound, a quinacridone compound, a base dye lake compound, a naphthol compound, a benzo imidazole compound, a thioindigo compound, or a perylene compound may be used. In detail, C.I. pigment red 2, 3, 5, 6, 7, 23, 48:2, 48:3, 48:4, 57:1, 81:1, 144, 146, 166, 169, 177, 184, 185, 202, 206, 220, 221, 254, etc. may be used.

For the cyan pigment, a copper phthalocyanine compound and derivatives thereof, an anthraquine compound, or a base dye lake compound may be used. In detail, C.I. pigment blue 1, 7, 15, 15:1, 15:2, 15:3, 15:4, 60, 62, 66, etc. may be used.

Such colorants may be used alone or in a combination of two or more colorants. The selection of the colorants and the mixing ratio of the colorants may be determined in consideration of color, chromacity, luminance, resistance to weather, dispersion properties of the toner, etc.

The amount of the colorant may be sufficient to color the toner and form a visible image by developing. For example, the amount of the colorant may be in the range of 3 to 15 parts by weight based on 100 parts by weight of the binder resin. If the amount of the colorant is less than 3 parts by weight, coloring effects are not sufficient. If the amount of the colorant is greater than 15 parts by weight, electric resistance of toner decreases, and thus a sufficient frictional charge amount may not be obtained, thereby causing contamination.

Meanwhile, the additives may be a charge control agent, a release agent, or any mixtures thereof.

The charge control agent used herein may be a negative charge type charge control agent or a positive charge type charge control agent. The negative charge type charge control agent may be an organic metal complex or a chelate compound such as a chromium-containing azo complex or a mono azo metal complex; a salicylic acid compound containing metal such as chromium, iron and zinc; or an organic metal complex of an aromatic hydroxycarboxylic acid or an aromatic dicarboxylic acid. Moreover, any known charge control agent may be used without limitation. The positive charge type charge control agent may be a modified product such as nigrosine and a fatty acid metal salt thereof; and an onium salt including a quaternary ammonium salt such as tributylbenzylammonium 1-hydroxy-4-naphthosulfonate and tetrabutylammonium tetrafluoro borate which may be used alone or in combination. Since the charge control agent stably and quickly charges the toner by electrostatic force, the toner may be stably supported by the charge control agent on a developing roller.

The amount of the charge control agent may be in the range of 0.1 to 10% by weight based on the weight of each of the toners.

The release agent improves fixing properties of a toner image. Examples of the releasing agent include polyalkylene wax such as low molecular weight polypropylene and low molecular weight polyethylene, ester wax, carnauba wax, and paraffin wax.

The additives may further include external additives. The external additives are used to improve fluidity of the toner or control charge properties of the toner. Examples of the external additives include large particulate silica, small particulate silica, and polymer beads.

Hereinafter, a method of preparing a toner used in a method of forming a toner image or by an electrophotographic image forming apparatus will be described in detail.

Preparation of Colorant Dispersion

A colorant, a surfactant, and a polar solvent are mixed in a predetermined ratio and the mixture is stirred to prepare a pre-dispersion. Then, the pre-dispersion is further dispersed until an average particle diameter of the dispersed colorant is in the range of 100 to 300 nm and has a uniform particle diameter distribution while preventing the temperature from increasing.

Preparation of Fluorescent Pigment Dispersion

A fluorescent pigment, a surfactant, and a polar solvent are mixed in a predetermined ratio, and the mixture is stirred to prepare a pre-dispersion. Then, the pre-dispersion is further dispersed until an average particle diameter of the dispersed fluorescent pigment is in the range of 100 to 300 nm and has a uniform distribution while preventing the temperature from increasing.

Preparation of Latex

A surfactant is mixed with ultrapure water from which dissolved oxygen is removed, in a predetermined ratio, and the mixture is heated to about 75° C. to prepare a dispersion medium. Then, a polymerization initiator is added to the dispersion medium. After a predetermined time period, a pre-emulsion including at least three types of monomers is added thereto for 2 hours. After about 8 hours, the heating is stopped and the resultant is naturally cooled to room temperature. In this regard, the pre-emulsion is prepared by mixing at least three types of monomers, a surfactant and selectively a molecular weight control agent, and stirring the mixture at a predetermined rate for a predetermined time period until the pre-emulsion has an appropriate viscosity.

Preparation of Toner

A toner having a core/shell structure is prepared using the colorant dispersion, the fluorescent pigment dispersion, and the latex prepared as described above.

First, the colorant dispersion, the fluorescent pigment dispersion, the latex, and an agglomerating agent are added to a reactor in a predetermined ratio, and the mixture is stirred at about 95° C. at about 400 rpm to perform agglomeration. Here, the agglomeration is performed in a nitrogen atmosphere in order to prevent the surface of the reactants from coming in contact with oxygen and volatile matters generated during the agglomeration are collected using a condenser. As a result, a toner core having an average particle diameter of about 5.5 μm is obtained.

Then, the latex for forming a toner shell (hereinafter, shell latex) is added to the reactor to cover the toner core. After the shell latex is added to the reactor, the mixture is treated at 95° C. for 2 to 5 hours to perform a coagulating process. By the coagulating process, the surface of the toner is smoothed, and circularity of the toner particles is improved. When the coagulating process is completed, a filtering and washing process is performed to remove the surfactant and fine particles. After the filtering and washing process, the resultant is dried using a fluidized bed dryer. As a result, a toner having a core/shell structure with an average particle diameter of about 6.0 μm is obtained.

The surfactant may include at least one selected from the group consisting of a nonionic surfactant, an anionic surfactant, a cationic surfactant, and a neutral surfactant.

Examples of the nonionic surfactant are polyvinyl alcohol, polyacrylic acid, methyl cellulose, ethyl cellulose, propyl cellulose, hydroxylethyl cellulose, carboxymethyl cellulose, polyoxyethylene cetyl ether, polyoxyethylene lauryl ether, polyoxyethylene octylphenyl ether, polyoxyethylene stearyl ether, polyoxyethylene norylphenyl ether, ethoxylate, phosphate norylphenols, triton, and dialkylphenoxypoly(ethyleneoxy)ethanol. Examples of the anionic surfactant are sodium dodecyl sulfate, sodium dodecyl benezene sulfonate, sodium dodecyl naphthalene sulfate, dialkyl benzenealkyl sulfate, and sulfonate. Examples of the cationic surfactant are alkyl benzene dimethyl ammonium chloride, alkyl trimethyl ammonium chloride, and distearyl ammonium chloride. Examples of the amphoteric surfactant are amino acid amphoteric surfactant, betaine amphoteric surfactant, lecitin, taurin, cocoamidopropylbetaine, and disodium cocoamphodiacetate.

The surfactants described above may be used alone or in combination.

The polar solvent may be at least one selected from the group consisting of water, glycerol, ethanol, ethylene glycol, propylene glycol, diethylene glycol, dipropylene glycol, and sorbitol, and preferably water.

The polymerization initiator may be potassium persulfate, ammonium persulfate, sodium persulfate, potassium persulfate, ammonium persulfate, sodium persulfate, ammonium bisulfate, sodium bisulfate, 1,1'-azobis(1-methylbutyronitrile-3-sodium sulfonate), or 4,4'-azobis(4-cyanovaleric acid) which are diluted in water such as deionized water.

A single to a plurality of monomer(s), preferably 1 to 10 monomer(s), and more preferably 1 to 5 monomer(s) may be used. The monomer may be acrylate, acrylate ester, methacrylate, methacrylate ester, styrene, vinyl ester of an aliphatic acid, and a known cross-linking agent, but is not limited thereto. The cross-linking agent may be divinyl benzene, divinyl toluene, diacrylate, or dimethacrylate. At least two monomers may be used. The monomer may be styrene, butyl acrylate, methacrylic acid, glycidylmethacrylate, or 1,10-dodecane diacrylate.

The molecular weight control agent is used to control the molecular weight of the latex. Examples of the molecular weight control agent include dodecanethiol, butanethiol, isooctyl-3-mercaptopropionate (IOMP), 2-methyl-5-t-butylthiophenol, carbon tetrachloride, and/or carbon tetrabromide.

The agglomerating agent may be a surfactant used in the colorant dispersion or the fluorescent pigment dispersion, a surfactant having a polarity opposite to that of the surfactant used in the dispersion, or an inorganic metal salt having monovalent or higher charges.

In general, as an ionic charge number increases, agglomerating forces increase. Thus, an agglomerating agent is selected in consideration of the agglomerating speed and stability. The inorganic metal salt having monovalent or higher charges may be calcium chloride, calcium acetate, barium chloride, magnesium chloride, sodium chloride, sodium sulfate, ammonium sulfate, magnesium sulfate, sodium phosphate, sodium biphosphate, ammonium chloride, cobalt chloride, strontium chloride, cesium chloride, nickel chloride, rubidium chloride, potassium chloride, sodium acetate, ammonium acetate, potassium acetate, sodium benzoate, aluminum chloride, zinc chloride, or the like.

The toner prepared according to the method described above may be used in an electrophotographic image forming apparatus. In this regard, the electrophotographic image forming apparatus includes laser printers, photocopiers, or facsimiles.

The present invention will be described in more detail with reference to the examples below, but is not limited thereto. The following examples are for illustrative purposes only and are not intended to limit the scope of the invention.

EXAMPLES

Preparation of Colorant Dispersion

Preparation Example 1-1

Preparation of Yellow Colorant Dispersion

A 3 L reactor equipped with a stirrer, a thermometer, and a condenser was installed in an oil bath including a heating medium. 50 g of Y415™ (Daicolor Pigment MFG. Co., Ltd., Japan), 10 g of Dowfax 2A1™ (Dow chemical company), 260 g of ion exchange water, and 400 g of glass beads having a diameter ranging from 0.75 to 1.0 mm were added to the reactor. The reactor contents were stirred at 500 rpm for 1 hour using a mechanical stirrer (SS-20DW, Global lab) to prepare a pre-dispersion. In this regard, the glass beads were used as dispersing media.

Then, the pre-dispersion was added to a Dispermat (VMA-GETZMANN GMBH) disperser and further dispersed. While dispersing in the Dispermat disperser, cooling water was circulated through a jacket cylinder to prevent the increasing of the temperature of the dispersion. The dispersion was performed at 7,000 rpm until an average particle diameter of the dispersed yellow colorant was in the range of 100 to 300 nm and had a uniform particle diameter distribution in the Dispermat disperser. The particle diameter and the particle diameter distribution of the dispersed yellow colorant particles were measured using a Mastersizer 2000 (Malvern Instruments, Inc.).

Preparation Example 1-2

Preparation of Magenta Colorant Dispersion

A magenta colorant dispersion was prepared in the same manner as in Preparation Example 1-1, except that 50 g of RED No. 36, PR122™ (Daicolor Pigment MFG. Co., Ltd., Japan) was used instead of the 50 g of Y415™ (Daicolor Pigment MFG. Co., Ltd., Japan).

Preparation Example 1-3

Preparation of Cyan Colorant Dispersion

A cyan colorant dispersion was prepared in the same manner as in Preparation Example 1-1, except that 50 g of ECB303™ (Daicolor Pigment MFG. Co., Ltd., Japan) was used instead of the 50 g of Y415™ (Daicolor Pigment MFG. Co., Ltd., Japan).

Preparation Example 1-4

Preparation of Black Colorant Dispersion

A black colorant dispersion was prepared in the same manner as in Preparation Example 1-1, except that 50 g of Mogul L™ (Cabot Corp., U.S.A.) was used instead of the 50 g of Y415™ (Daicolor Pigment MFG. Co., Ltd., Japan).

Preparation of Fluorescent Pigment Dispersion

Preparation Example 2-1

Preparation of Yellow Fluorescent Pigment Dispersion

A yellow fluorescent pigment dispersion was prepared in the same manner in Preparation Example 1-1, except that 50 g of FB205™ (Uk Seong Chemical Co., Ltd., Korea) was used instead of the 50 g of Y415™ (Daicolor Pigment MFG. Co., Ltd., Japan).

Preparation Example 2-2

Preparation of Magenta Fluorescent Pigment Dispersion

A magenta fluorescent pigment dispersion was prepared in the same manner as in Preparation Example 1-1, except that 50 g of FZ 27110™ (Sinloihi Co., Ltd., Japan) was used instead of the 50 g of Y415™ (Daicolor Pigment MFG. Co., Ltd., Japan).

Preparation Example 2-3

Preparation of Cyan Fluorescent Pigment Dispersion

A cyan fluorescent pigment dispersion was prepared in the same manner as in Preparation Example 1-1, except that 50 g of FZ SB BLUE™ (Sinloihi Co., Ltd., Japan) was used instead of the 50 g of Y415™ (Daicolor Pigment MFG. Co., Ltd., Japan).

Preparation of Latex

Preparation Example 3

3.2 g of Dowfax as an anionic surfactant was mixed with 660 g of ultrapure water from which dissolved oxygen was removed, in a 3 L reactor, and the reactor was heated to 75° C. When the temperature of the reactor reached 75, a polymerization initiator solution prepared by dissolving 18 g of potassium persulfate in 500 g of ultrapure water was added to the reactor. After 10 minutes, a pre-emulsion was added to the reactor for 2 hours. Here, the pre-emulsion solution was prepared by mixing 970 g of styrene, 192 g of butyl acrylate, 36 g of acrylic acid, 22 g of an anionic surfactant (Dowfax), and 507 g of ultrapure water and stirring the mixture at 300 rpm for about 30 minutes. After 8 hours of reaction, the heating was stopped and the resultant was naturally cooled to room temperature to collect the latex.

Preparation of Toner

Examples 1-1 to 1-6

Preparation of Yellow Toners (Y-1 to Y-6)

Toners having a core/shell structure were prepared using the yellow colorant dispersion, the fluorescent pigment dispersion, and the latex.

First, the yellow colorant dispersion prepared according to Preparation Example 1-1, the yellow fluorescent pigment dispersion prepared according to Preparation Example 2-1, and the latex (for core) prepared according to Preparation Example 3 were quantified such that the weight ratios of the yellow colorant particles: the yellow fluorescent pigment particles: the latex particles: an agglomerating agent are those shown in Table 1 below. Then, they were added to a 3 L reactor equipped with a stirrer, a nitrogen gas inlet, a thermometer, and a condenser. Then, magnesium chloride ($MgCl_2$) was added to the reactor to perform a first agglomeration, and sodium chloride (NaCl) was added thereto to perform a second agglomeration. In this regard, the first agglomeration was continued until the particle size of the toner reached 4.0 μm, and the second agglomeration was initiated when the particle size of the toner reached 4.0 μm. The second agglomeration was continued until the particle size of the toner reached 5.5 μm. The amounts of the $MgCl_2$ and NaCl were varied as shown in Table 1 below. The agglomeration was performed by stirring the reactor at 95° C. at 400 rpm using a mechanical stirrer (SS-20DW, Global lab). The agglomeration was performed in a nitrogen atmosphere in order to prevent the surface of the reactants from coming in contact with oxygen, and evaporated volatile materials were condensed using a condenser to be collected to the reactor. A double blade type impeller was used as the stirrer. As a result, a toner core having a particle diameter of 5.5 μm was obtained. Then, 217 g of the latex (for shell, i.e., shell latex) was added to the reactor to cover the surface of the toner core. After the shell latex was added, a coagulating process was performed at 95° C. for 3 hours. After the coagulating process was completed, a filtering and washing process was performed to remove the surfactant and fine particles. First to third filtering and washing processes were performed using a vacuum pump (ULVAC KIKO Inc., DA-60S) and using distilled water with a volume three times that of the subject for the filtering/washing. After the third filtering and washing process, the pH of the subject for the filtering/washing was adjusted to 2 by adding a 0.3M nitric acid solution to the subject, and fourth to eighth filtering and washing processes were performed using distilled water with a volume five times that of the subject. After the filtering and washing process was finished, the resultant was dried using a fluidized bed dryer (Sherwood, FBD501) at 40° C. for 6 to 8 hours. As a result, yellow toners (Y-1 to Y-6) having a core/shell structure with an average particle diameter of about 6.0 μm were obtained.

TABLE 1

| | | Example 1-1 Y-1 | Example 1-2 Y-2 | Example 1-3 Y-3 | Example 1-4 Y-4 | Example 1-5 Y-5 | Example 1-6 Y-6 |
|---|---|---|---|---|---|---|---|
| Yellow colorant particles, wt % | | 5 | 5 | 5 | 5 | 5 | 5 |
| Yellow fluorescent pigment particles, wt % | | 0.05 | 0.1 | 0.5 | 1.0 | 2.0 | 3.0 |
| Latex particles | for core, wt % | 56.00 | 55.97 | 55.70 | 55.38 | 54.73 | 52.08 |
| | for shell, wt % | 30.15 | 30.13 | 30.00 | 29.82 | 29.47 | 29.12 |
| Agglomerating agent | $MgCl_2$, wt % | 2.4 | 2.4 | 2.4 | 2.4 | 2.4 | 2.4 |
| | NaCl, Wt % | 6.4 | 6.4 | 6.4 | 6.4 | 6.4 | 6.4 |

Examples 2-1 to 2-6

Preparation of Magenta Toners (M-1 to M-6)

Magenta toners (M-1 to M-6) were prepared in the same manner as in Examples 1-1 to 1-6, except that the magenta colorant dispersion prepared according to Preparation Example 1-2, the magenta fluorescent pigment dispersion prepared according to Preparation Example 2-2, the latex prepared according to Preparation Example 3, and the agglomerating agent were used such that the weight ratios of the magenta colorant particles: the magenta fluorescent pigment particles: the latex particles: the agglomerating agent are those shown in Table 2 below, instead of using the yellow colorant dispersion prepared according to Preparation Example 1-1, the yellow fluorescent pigment dispersion prepared according to Preparation Example 2-1, the latex prepared according to Preparation Example 3, and the agglomerating agent in the weight ratios of the yellow colorant particles: the yellow fluorescent pigment particles: the latex particles: the agglomerating agent shown in Table 1.

TABLE 2

| | | Example 2-1 M-1 | Example 2-2 M-2 | Example 2-3 M-3 | Example 2-4 M-4 | Example 2-5 M-5 | Example 2-6 M-6 |
|---|---|---|---|---|---|---|---|
| Magenta colorant particles, wt % | | 5 | 5 | 5 | 5 | 5 | 5 |
| Magenta fluorescent pigment particles, wt % | | 0.05 | 0.1 | 0.5 | 1.0 | 2.0 | 3.0 |
| Latex particles | for core, wt % | 55.09 | 55.06 | 54.80 | 54.47 | 53.82 | 53.17 |
| | for shell, wt % | 29.66 | 29.64 | 29.50 | 29.33 | 28.98 | 28.63 |
| Agglomerating agent | $MgCl_2$, wt % | 4.4 | 4.4 | 4.4 | 4.4 | 4.4 | 4.4 |
| | NaCl, Wt % | 5.8 | 5.8 | 5.8 | 5.8 | 5.8 | 5.8 |

Examples 3-1 to 3-6

Preparation of Cyan Toners (C-1 to C-6)

Cyan toners (C-1 to C-6) were prepared in the same manner as in Examples 1-1 to 1-6, except that the cyan colorant dispersion prepared according to Preparation Example 1-3, the cyan fluorescent pigment dispersion prepared according to Preparation Example 2-3, the latex prepared according to Preparation Example 3, and the agglomerating agent were used such that the weight ratios of the cyan colorant particles: the cyan fluorescent pigment particles: the latex particles: the agglomerating agent are those shown in Table 3 below, instead of using the yellow colorant dispersion prepared according to Preparation Example 1-1, the yellow fluorescent pigment dispersion prepared according to Preparation Example 2-1, the latex prepared according to Preparation Example 3, and the agglomerating agent in the weight ratios of the yellow colorant particles: the yellow fluorescent pigment particles: the latex particles: the agglomerating agent shown in Table 1.

TABLE 3

| | | Example 3-1 C-1 | Example 3-2 C-2 | Example 3-3 C-3 | Example 3-4 C-4 | Example 3-5 C-5 | Example 3-6 C-6 |
|---|---|---|---|---|---|---|---|
| Cyan colorant particles, wt % | | 5 | 5 | 5 | 5 | 5 | 5 |
| Cyan fluorescent pigment particles, wt % | | 0.05 | 0.1 | 0.5 | 1.0 | 2.0 | 3.0 |
| Latex particles | for core, wt % | 55.09 | 55.06 | 54.80 | 54.47 | 53.82 | 53.17 |
| | for shell, wt % | 29.66 | 29.64 | 29.50 | 29.33 | 28.98 | 28.63 |
| Agglomerating agent | $MgCl_2$, wt % | 4.4 | 4.4 | 4.4 | 4.4 | 4.4 | 4.4 |
| | NaCl, wt % | 5.8 | 5.8 | 5.8 | 5.8 | 5.8 | 5.8 |

Comparative Examples 1 to 4

Preparation of Yellow Toner [Ref(Y)], Magenta Toner [Ref(M)], Cyan Toner [Ref(C)], and Black Toner [Ref(K)]

Toners [Ref(Y), Ref(M), Ref(C), and Ref(K)] were prepared in the same manner as in Examples 1-1 to 1-6, except that the colorant dispersions prepared according to Preparation Examples 1-1 to 1-4, the latex prepared according to Preparation Example 3, and the agglomerating agent were used such that the weight ratios of the colorant particles: the latex particles: the agglomerating agent are those shown in Table 4 below, without using the fluorescent pigment dispersions prepared according to Preparation Examples 2-1 to 2~3.

TABLE 4

| | | Comparative Example 1 Ref(Y) | Comparative Example 2 Ref(M) | Comparative Example 3 Ref(C) | Comparative Example 4 Ref(K) |
|---|---|---|---|---|---|
| Colorant particles, wt % | | 5 | 5 | 5 | 5 |
| Fluorescent pigment particles, wt % | | 0 | 0 | 0 | 0 |
| Latex particles | for core, wt % | 56.03 | 55.12 | 55.12 | 56.10 |
| | for shell, wt % | 30.17 | 29.68 | 29.68 | 30.20 |
| Agglomerating agent | $MgCl_2$, wt % | 2.4 | 4.4 | 4.4 | 2.9 |
| | NaCl, Wt % | 6.4 | 5.8 | 5.8 | 5.8 |

The toner particles prepared according to the examples and the comparative examples are evaluated as follows.

Preparation of Toner Including External Additives 150 g of each of the toners prepared according to Examples 1-1 to 3-6 and Comparative Examples 1 to 4, 0.75 g of hydrophobic silica (TG 810G, Cabot Corp., U.S.A.), 2.25 g of hydrophobic silica (TG308F, Cabot Corp., U.S.A.), and 0.75 g of titanium oxide (SW100, Titan Kogyo Corp.) were mixed, and the mixture was stirred at 3,000 rpm for 5 minutes using a Picolo mixer (Kawata, Co., Ltd.) to prepare a toner including external additives.

Measurements of Color Gamut and Chromaticity

The toner including external additives was filled in a cartridge of a CLP-510 color printer (Samsung) a standard chart (a QEA chart) was printed onto a A4 paper.

(Evaluation of Color Tone)

Color tones were evaluated with the naked eye by observing the degree of discoloration of the each toner including external additives according to the addition of the fluorescent pigment. O, Δ, or X was used to indicate the results of the evaluation.

O: No discoloration of toner.

Δ: Slight discoloration of toner, good image quality

X: Serious discoloration of toner, poor image quality

Measurement of Volume Average Particle Diameter

The volume average particle diameter was measured using a Coulter Multisizer 3 including 100 μm of an aperture tube. Samples were prepared by mixing 50 to 100 ml of an electrolyte of ISOTON-II (Beckman Coulter Inc.), a surfactant, and 10 to 20 mg of the each toner including external additives in the Coulter Multisizer 3, and dispersing the mixture for 1 minute using an ultrasonic homogenizer.

TABLE 5

| | | Color gamut | | | | Color | Volume average particle |
|---|---|---|---|---|---|---|---|
| | | L | a | b | Chromaticity | tone | diameter (μm) |
| Example 1-1 | Y-1 | 91.28 | −9.38 | 77.40 | 77.96 | ○ | 6.2 |
| Example 1-2 | Y-2 | 92.54 | −10.10 | 78.10 | 78.75 | ○ | 6.3 |
| Example 1-3 | Y-3 | 93.55 | −9.88 | 81.76 | 82.35 | ○ | 6.5 |
| Example 1-4 | Y-4 | 93.67 | −10.05 | 81.89 | 82.50 | ○ | 6.4 |
| Example 1-5 | Y-5 | 93.54 | −9.92 | 81.90 | 82.50 | Δ | 6.1 |
| Example 1-6 | Y-6 | 92.78 | −9.78 | 81.88 | 82.46 | X | 5.8 |
| Example 2-1 | M-1 | 56.78 | 56.01 | −5.89 | 56.32 | ○ | 6.1 |
| Example 2-2 | M-2 | 57.41 | 57.38 | −6.05 | 57.70 | ○ | 6.0 |
| Example 2-3 | M-3 | 59.21 | 59.40 | −5.95 | 59.70 | ○ | 6.2 |
| Example 2-4 | M-4 | 60.18 | 60.65 | −6.01 | 60.95 | ○ | 6.5 |
| Example 2-5 | M-5 | 60.09 | 59.38 | −5.97 | 59.68 | Δ | 6.7 |
| Example 2-6 | M-6 | 60.67 | 58.98 | −6.02 | 59.29 | X | 6.1 |
| Example 3-1 | C-1 | 58.90 | −30.95 | −37.55 | 48.66 | ○ | 6.6 |
| Example 3-2 | C-2 | 59.50 | −31.00 | −39.10 | 49.90 | ○ | 6.5 |
| Example 3-3 | C-3 | 60.78 | −31.75 | −40.10 | 51.15 | ○ | 6.4 |
| Example 3-4 | C-4 | 61.05 | −32.08 | −41.78 | 52.68 | ○ | 6.0 |
| Example 3-5 | C-5 | 60.98 | −32.01 | −40.99 | 52.01 | Δ | 6.1 |
| Example 3-6 | C-6 | 61.03 | −31.92 | −41.23 | 52.14 | X | 6.3 |
| Comparative Example 1 | Ref (Y) | 90.41 | −9.15 | 75.38 | 75.93 | ○ | 5.9 |
| Comparative Example 2 | Ref (M) | 55.33 | 54.78 | −6.01 | 55.11 | ○ | 6.2 |
| Comparative Example 3 | Ref (C) | 58.71 | −30.78 | −35.04 | 46.64 | ○ | 6.3 |
| Comparative Example 4 | Ref (K) | 29.54 | 0.33 | 3.26 | 3.28 | ○ | 5.9 |

(Color Gamut)

'L', 'a', and 'b' of a first color (Yellow, Magenta, Cyan) of a toner image printed on the A4 paper was measured using a SpectroEye (Macbeth). The results are shown in Table 5.

In addition, color coordinates of the toners each including external additives and one of the toners (Y-4, M-4, and C-4) prepared according to Examples 1-4, 2-4, and 3-4 including 1% by weight of the fluorescent pigment based on the weight of the toner, and color coordinates of the toners each including external additives and one of the toners (yellow toner [Ref(Y)], magenta toner [Ref(M)], cyan toner [Ref(C)], and black toner [Ref(K)]) prepared according to Comparative Examples 1 to 4 are shown in FIG. 1. In addition, FIG. 2 is a scanning electron microscope image of the toner (Y-4) prepared according to Example 1-4.

(Chromaticity)

Chromaticity indicates the degree of color clearness and a distance between the origin and a color coordinate point. Thus, chromaticity$=(a^2+b^2)^{1/2}$.

Figure 2:
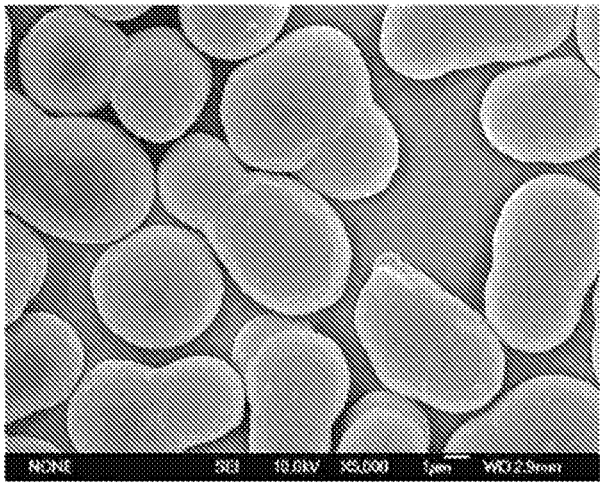
FIG. 2 is a scanning electron microscope image of a toner prepared by a method of forming a toner image according to an embodiment of the present invention.

Referring to Table 5 and FIG. 2, toner including the fluorescent pigment, prepared according to Examples 1-1 to 3-6 has a wider color gamut and higher chromaticity compared with toner without the fluorescent pigment, prepared according to Comparative Examples 1 to 4. However, the volume average particle diameter of the toner prepared according to Examples 1-1 to 3-6 is similar to that of the toner prepared according to Comparative Examples 1 to 4. The color tone is decreased when a large amount, i.e., 2% or more by weight based on the weight of the toner, of the fluorescent pigment is used.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A toner set for forming color image comprising:

a first toner having a yellow color and color coordinate values of a lightness (L) ranging from 91 to 94, a redness (a) ranging from −11 to −9, and a yellowness (b) ranging from 77 to 82;

a second toner having a magenta color and color coordinate values of a lightness (L) ranging from 56 to 61, a redness (a) ranging from 56 to 61, and a yellowness (b) ranging from −7 to −5; and a third toner having a cyan color and color coordinate values of a lightness (L) ranging from 58 to 62, a redness (a) ranging from −33 to −30, and a yellowness (b) ranging from −42 to −37, wherein the first to third toners respectively comprise not less than 0.05% and less than 2.0% by weight of a fluorescent pigment based on the weight of each of the first to third toners.

2. The toner set of claim 1, wherein the fluorescent pigment is selected from the group consisting of 4,4'-bis(styryl)biphenyl, 2-(4-phenylstilbene-4-y1)-6-butylbenzoxazole, β-methylumbelliferon, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene.

3. A color image forming apparatus comprising:

a first toner having a yellow color and color coordinate values of a lightness (L) ranging from 91 to 94, a redness (a) ranging from −11 to −9, and a yellowness (b) ranging from 77 to 82;

a second toner having a magenta color and color coordinate values of a lightness (L) ranging from 56 to 61, a redness (a) ranging from 56 to 61, and a yellowness (b) ranging from −7 to −5; and a third toner having a cyan color and color coordinate values of a lightness (L) ranging from 58 to 62, a redness (a) ranging from −33 to −30, and a yellowness (b) ranging from −42 to −37, wherein the first to third toners respectively comprise not less than 0.05% and less than 2.0% by weight of a fluorescent pigment.

* * * * *

UNITED STATES PATENT AND TRADEMARK OFFICE

CERTIFICATE OF CORRECTION

PATENT NO. : 8,492,060 B2
APPLICATION NO. : 12/996365
DATED : July 23, 2013
INVENTOR(S) : Choi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 205 days.

Signed and Sealed this
Eighth Day of September, 2015

Michelle K. Lee

Michelle K. Lee
*Director of the United States Patent and Trademark Office*